US006679170B2

(12) United States Patent
Mori

(10) Patent No.: US 6,679,170 B2
(45) Date of Patent: Jan. 20, 2004

(54) PRINTING METHOD AND PRINTING PRESS

(75) Inventor: Takahiro Mori, Hino (JP)

(73) Assignee: Konica Corporation (JP)

( * ) Notice: Subject to any disclaimer, the term of this patent is extended or adjusted under 35 U.S.C. 154(b) by 28 days.

(21) Appl. No.: 10/029,317

(22) Filed: Dec. 20, 2001

(65) Prior Publication Data

US 2002/0088360 A1 Jul. 11, 2002

(30) Foreign Application Priority Data

Jan. 16, 2001 (JP) ..... 2001-007659

(51) Int. Cl.[7] ..... B41C 1/10
(52) U.S. Cl. ..... 101/465; 101/451
(58) Field of Search ..... 101/463.1, 465, 101/466, 467, 148, 450.1, 451, 378, 415.1

(56) References Cited

U.S. PATENT DOCUMENTS 4,886,352 A * 12/1989 Ozawa et al. ..... 355/28
5,345,870 A * 9/1994 Bailey et al. ..... 101/463.1
5,413,043 A * 5/1995 Fuhrmann et al. ..... 101/415.1
6,030,750 A * 2/2000 Vermeersch et al. ..... 101/463.1
6,387,591 B1 * 5/2002 Leenders et al. ..... 101/467
6,484,638 B2 * 11/2002 Verschueren et al. ..... 101/467
2002/0029711 A1 * 3/2002 D'Amato ..... 101/467

* cited by examiner

*Primary Examiner*—Stephen R. Funk
(74) *Attorney, Agent, or Firm*—Muserlian, Lucas and Mercanti

(57) ABSTRACT

A method of printing employing a printing plate prepared from a printing plate precursor comprising a layer A capable of being removed by water or both water and ink on a printing press comprises the steps of imagewise exposing the precursor, mounting the precursor on a plate cylinder of the printing press to fix the precursor at a fixing section on the plate cylinder, providing a water repellent area in the layer A of the precursor so that the water repellent area is provided between a portion of the layer A to be used for printing and a portion of the layer A in the fixing section not to be used for printing, supplying water or both water and ink to the resulting precursor to obtain a printing plate; and then carrying out printing while supplying water or both water and ink to the resulting printing plate.

12 Claims, 4 Drawing Sheets

FIG. 2 ( a )
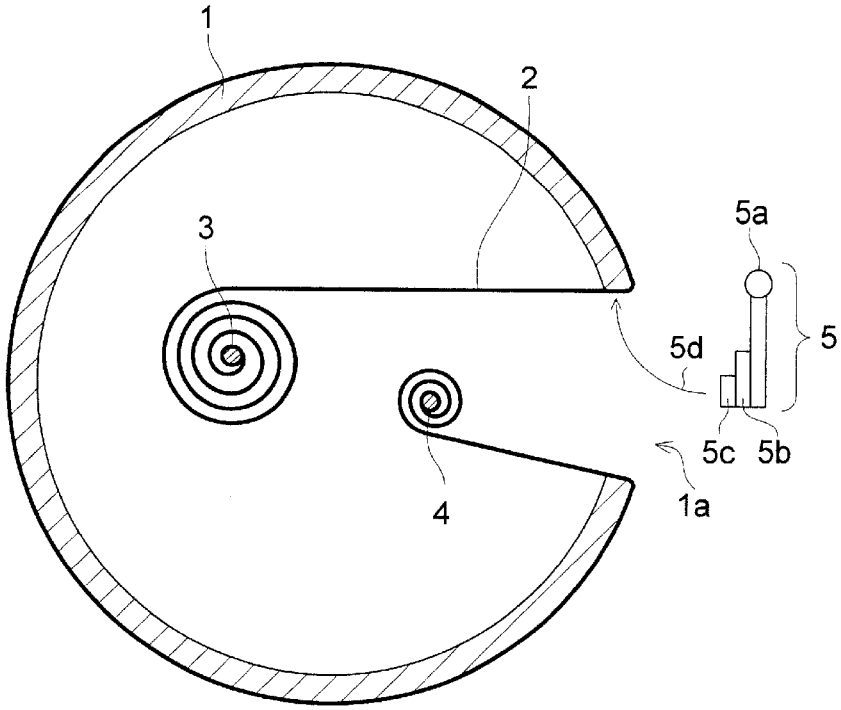
FIG. 2 ( b )
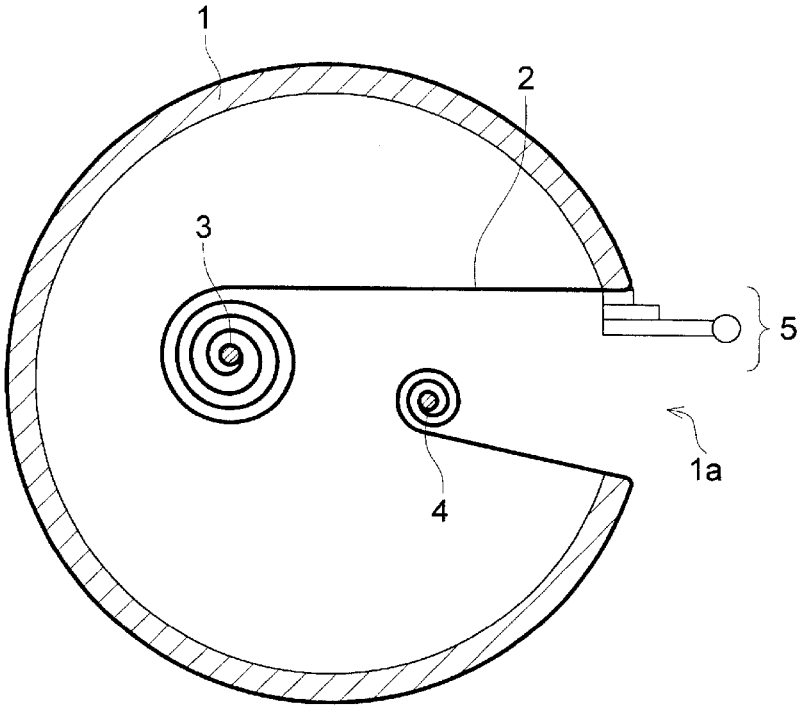

PRINTING METHOD AND PRINTING PRESS

FIELD OF THE INVENTION

The present invention relates to a printing method and a printing press, and particular to a printing method with no penetration of a dampening water into an area of an on-press type printing plate at which the printing plate is gripped and fixed, and a printing press employed the method.

BACKGROUND OF THE INVENTION

Recently, a printing press equipped with an image forming means represented by an infrared laser irradiation device, so-called a DI printing press, has been focused on as a system for prompt delivery of prints and reduction of printing cost. As the DI printing press, there are a printing press employing a dampening water and a waterless type printing press employing no dampening water, as in an ordinary printing press.

The waterless type DI printing press has no device supplying a dampening water, and if equipped with an image forming means, it can provide a compact construction. For example, printing presses such as Quickmaster-46-DI produced by Heiderberg Co., Ltd and 3404DI produced by Ryobi Co., Ltd. have advantages that they can be installed anywhere in a reduced space, although they have a means for storing a printing plate precursor (hereinafter referred to also as a plate precursor) in the roll form within a cylinder, means for winding the plate precursor around the cylinder, and means for uptaking the plate precursor within the cylinder.

They have also advantages in that, once the plate precursor in the roll form is stored within the cylinder, a printing plate can be automatically exchanged at a certain frequency.

These are printing presses having a plate cylinder as disclosed in, for example, U.S. Pat. No. 5,657,692. That is, as is shown in the schematic view of a plate cylinder in FIG. 1, the plate cylinder has, within the cylinder 1, a supply spool 3 with a plate precursor 2 wound therearound and an uptake spool 4 (both supply spool 3 and uptake spool 4 having their core). The plate cylinder has a construction in which the plate precursor is stored in the roll form on supply spool 3 within the cylinder, unrolled, withdrawn through an axial opening 1*a*, brought on the outer surface of the cylinder to wrap the cylinder, reintroduced through axial opening la into the cylinder, and received by uptake spool 4 within the cylinder.

Fixation of a plate precursor on the plate cylinder can be carried out, for example, by locking either one of the supply spool or the uptake spool not to rotate, applying a rotational torque in the rotational direction to the other spool to give a certain tension to the plate precursor, and then locking it.

Further, as in a printing press disclosed in Japanese Patent O.P.I. Publication Nos. 11-28802, which has a plate cylinder composed of two cylinders, one being an outer hollow cylinder having orifices and the other an inner cylinder, fixation of a plate precursor on the plate cylinder can be carried out by mounting the plate precursor on the outer, hollow cylinder, and then sucking air beneath the outer cylinder through the orifices.

However, commercially available waterless plate precursors used in the DI printing press require plate cleaning after laser irradiation for forming an image. This plate cleaning process results in an increase of preparation time for printing and a resultant cost increase.

In contrast, when a printing plate precursor capable of being developed on press (so-called an on-press type printing plate precursor) is used in the DI printing press employing a dampening water, printing can start without plate cleaning, which results in printing cost reduction due to shortening of the preparation time for printing.

The on-press type printing plate precursor comprises a layer which contains a water soluble material or a water swellable material and is capable of being removed on a plate cylinder of a printing press. This layer is dissolved in or swelled by, a dampening water from a dampening water supply device of a printing press to reduce its strength, and is removable.

This layer, when a plate precursor is mounted on a plate cylinder of a printing press, is continuous, and present at a plate fixing section, for example, at a plate gripping section of a printing press. Therefore, a printing plate prepared from the plate precursor has the problem that a dampening water penetrates to the plate gripping section during printing, dissolves or swells the layer at that section, reducing strength of the layer, which results in deterioration of plate fixing stability or plate gripping stability.

Further, a construction storing a plate precursor in the roll form within a plate cylinder of a printing press also has the problem that a dampening water penetrates to the surface of the plate precursor on the storing side, resulting in deterioration of performance of the plate precursor.

SUMMARY OF THE INVENTION

An object of the invention is to provide a printing method employing an on-press type printing plate precursor and improving a plate fixing stability and a registering accuracy, and to provide a printing method employing an on-press type printing plate precursor in the roll form stored within a plate cylinder of a printing press and minimizing deterioration of printing performance thereof. Another object of the invention is to provide a printing press capable of realizing the printing method described above.

BRIEF EXPLANATION OF THE DRAWING

FIG. 2 shows a sectional view of an embodiment of a plate cylinder of an inventive printing press which comprises a heated member contacting system, and stores a printing plate precursor in the roll form within the plate cylinder.

DETAILED DESCRIPTION OF THE INVENTION

Figure 1:
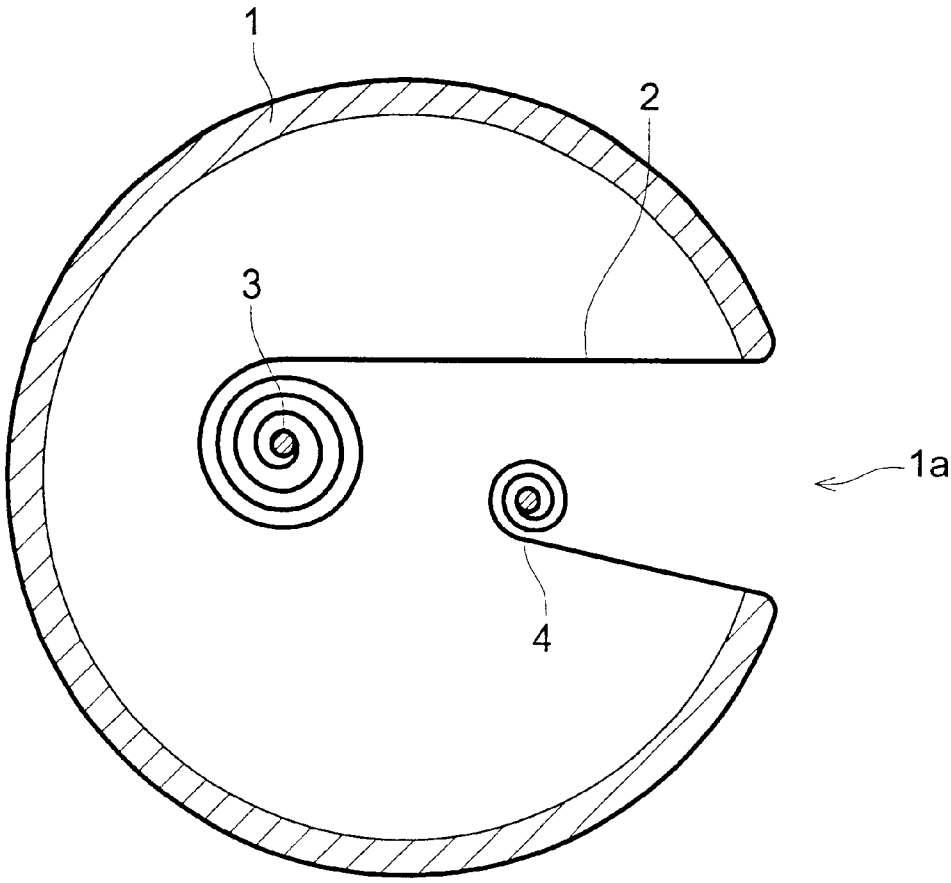
FIG. 1 PRIOR ART
FIG. 1 shows a sectional view of a plate cylinder of a conventional printing press in which a printing plate precursor in the roll form is stored within the plate cylinder.

The above object has been attained by one of the following constitutions:

1. A method of printing employing a printing plate prepared from a printing plate precursor comprising a layer A capable of being removed by water or both water and ink on a printing press, the method comprising the steps of imagewise exposing the printing plate precursor, mounting the printing plate precursor on a plate cylinder of the printing press to fix the printing plate precursor at a fixing section on the plate cylinder, providing a water repellent area in the layer A of the printing plate precursor so that the water repellent area is provided between a portion of the layer A to be used for printing and a portion of the layer A in the fixing section not to be used for printing, supplying water or both water and ink to the resulting printing plate precursor to obtain a printing plate where image portions are formed at exposed portions, and then carrying out printing while supplying water or both water and ink to the resulting printing plate, 2. The method of item 1, wherein the water repellent area in the layer A is provided continuously in the direction (a transverse direction of the plate precursor) normal to the rotational direction of the plate cylinder, 3. The method of item 1, wherein the water repellent area in the layer A is formed by exposing to infrared laser an area corresponding to the water repellent area, 4. The method of item 1, wherein the water repellent area in the layer A is formed by contacting an area corresponding to the water repellent area with a heated member, 5. The method of item 1, wherein the water repellent area in the layer A is formed by coating an oleophilic material on an area corresponding to the water repellent area, 6. A method of printing employing a printing plate prepared from a printing plate precursor comprising a layer A capable of being removed by water or both water and ink on a printing press comprising a plate cylinder, and a supply spool for storing and supplying the printing plate precursor in the roll form and an uptake spool for uptaking the plate precursor, which are fixed within the plate cylinder, the printing press being constructed so that the printing plate precursor is withdrawn from the supply spool, brought on an outer surface of the plate cylinder to wind therearound, and uptaken by the uptake spool, the method comprising the steps of bringing the printing plate precursor on the outer surface of the plate cylinder to wind therearound, imagewise exposing the wound printing plate precursor, providing a water repellent area in the layer A of the plate precursor so that the water repellent layer is provided between a portion of the layer A to be used for printing of the layer A and a portion of the layer A not to be used for printing on the supply spool side, supplying water or both water and ink to the resulting printing plate precursor to obtain a printing plate where image portions are formed at exposed portions, and then carrying out printing while supplying water or both water and ink to the resulting printing plate, 7. The method of item 6, wherein the water repellent area in the layer A is provided continuously in the direction (a transverse direction of the plate precursor) normal to the rotational direction of the plate cylinder, 8. The method of item 6, wherein the water repellent area in the layer A is formed by exposing to infrared laser an area corresponding to the water repellent area, 9. The method of item 6, wherein the water repellent area in the layer A is formed by contacting an area corresponding to the water repellent area with a heated member, 10. The method of item 6, wherein the water repellent area in the layer A is formed by coating an oleophilic material on an area corresponding to the water repellent area, 11. A printing press capable of mounting a printing plate precursor comprising a layer A capable of being removed by water or both water and ink on the printing press, the printing press comprising a plate cylinder for mounting the printing plate precursor, a fixing section at which the printing plate precursor is fixed on the plate cylinder, and a water-repellency providing member for providing a water repellent area in the layer A so that the water repellent area is provided between a portion of the layer A to be used for printing and a portion of the layer A in the fixing section not to be used for printing before printing is carried out, 12. The printing press of item 11, wherein the water repellency-providing member is infrared laser, 13. The printing press of item 11, wherein the water-repellency providing member is a heated member which is constructed so that the heated member contacts an area corresponding to the water repellent area, 14. The printing press of item 11, wherein the water repellency providing member is a coating member for coating an oleophilic material on an area corresponding to the water repellent area, 15. The printing press of item 11, wherein the infrared laser can carry out scanning exposure over the same width (in the direction parallel to the rotational axis of the plate cylinder) as, or over the width greater than, that of the printing plate precursor mounted, 16. A printing press comprising a plate cylinder, a supply spool for storing and supplying a printing plate precursor in the roll form, which is fixed within the plate cylinder, the printing plate precursor comprising a layer A capable of being removed by water or both water and ink on the plate cylinder, a winding member for unrolling and winding the plate precursor around the plate cylinder, an uptake spool for uptaking the plate precursor, which is fixed within the plate cylinder, and a water-repellency providing member for providing a water repellent area in the layer A so that the water repellent area is provided between a portion of the layer A to be used for printing and a portion of the layer A not to be used for printing on the supply pool side, 17. The printing press of item 16, wherein the water-repellency-providing member is infrared laser, 18. The printing press of item 16, wherein the water-repellency providing member is a heated member which is constructed so that the heated member contacts an area corresponding to the water repellent area, 19. The printing press of item 16, wherein the water repellency providing member is a coating member for coating an oleophilic material on an area corresponding to the water repellent area, 20. The printing press of item 17, wherein the infrared laser can carry out scanning exposure over the same width (in the direction parallel to the rotational axis of the plate cylinder) as, or over the width greater than, that of the printing plate precursor mounted, 21. A method of printing employing a printing plate precursor comprising a layer A capable of being removed by water or both water and ink mounted on a printing press, wherein the method comprises the steps of providing a water repellent area in the layer A of the plate precursor so that the water repellent area is provided between a portion of the layer A to be used for printing and a portion of the layer A in a fixing section of the printing plate precursor, and then carrying out printing, 22. A method of printing employing a printing plate precursor comprising a layer A capable of being removed by water or both water and ink on a printing press, which comprises a plate cylinder and within the plate cylinder, a supply spool for storing and supplying the printing plate precursor in the roll form and an uptake spool for uptaking the plate precursor, and is constructed so that the printing plate precursor is withdrawn from the supply spool, brought on the outer surface of the plate cylinder to wind therearound, and uptaken by the uptake spool, wherein the method comprises the steps of providing a water repellent area in the layer A of the plate precursor so that the water repellent area is provided between a portion of the layer A to be used for printing and a portion of the layer A of the printing plate precursor on the supply spool side, and then carrying out printing, 23. The method of item 21 or 22, wherein the water repellent area in the layer A is provided continuously over the entire direction (a transverse direction of the plate precursor) normal to the rotational direction of the plate cylinder, 24. The method of any one of items 21 to 23, wherein the water repellent area in the layer A is formed by exposing to infrared laser an area corresponding to the water repellent area, 25. The method of any one of items 21 to 23, wherein the water repellent area in the layer A is formed by contacting an area corresponding to the water repellent area with a heated member, 26. The method of any one of items 21 to 23, wherein the water repellent area in the layer A is formed by coating an oleophilic material on an area corresponding to the water repellent area, 27. A printing press capable of mounting a printing plate precursor comprising a layer A capable of being removed by water or both water and ink on the printing press, wherein the printing press further comprises a water repellency-providing member for providing a water repellent area in the layer A so that the water repellent area is provided between a portion of the layer A to be used for printing and a portion of the layer A in a fixing section of the printing plate precursor before printing is carried out, 28. A printing press comprising a plate cylinder, a storing member for storing a printing plate precursor in the roll form within the cylinder, a winding member for unrolling and winding the plate precursor around the cylinder, an uptake member for uptaking the plate precursor within the cylinder, wherein the printing press further comprises a water repellency-providing member for providing a water repellent area in a layer A of the printing precursor between a portion of the layer A to be used for printing and a portion in the layer A on the storing member side before printing is carried out, 29. The printing press of item 27 or 28, wherein the water repellency-providing member is infrared laser, 30. The printing press of item 27 or 28, wherein the water-repellency providing member is a heated member, which is constructed so that the heated member contacts the area corresponding to the water repellent area, 31. The printing press of item 27 or 28, wherein the water repellency providing member is a coating member for coating an oleophilic material on the area corresponding to the water repellent area, or 32. A printing press comprising an infrared laser as an exposure source, wherein the infrared laser can carry out scanning exposure over the same width as, or over the width greater than, the width of a printing plate precursor mounted on a plate cylinder of the printing press.

The present invention will be detailed below.

The present invention is characterized in that the method of printing comprises the steps of imagewise exposing a printing plate precursor comprising a layer A capable of being removed by water or both water and ink, mounting the printing plate precursor on a plate cylinder of a printing press to fix the plate precursor at a fixing section of the plate cylinder, providing a water repellent area in the layer A so that the water repellent area is provided between a portion of the layer A to be used for printing and a portion of the layer A in the fixing section not to be used for printing, and carrying out printing. The fixing section herein referred to resides both in the leading edge of the printing plate precursor and in the rear edge of the printing plate precursor in the rotational direction of the plate cylinder. When the plate precursor is in the roll form wound around two spools, that is, a supply spool for supplying a plate precursor and an uptake spool for receiving a spent plate, it is necessary to provide a water repellent area on the supply spool side, but the water repellent area may be provided also on the uptake spool side. Herein, "a portion for printing" does not include a portion in the plate precursor to be removed by for example, off-cut. The water repellent area may be provided at an area of a plate precursor in which a register mark is made. The water repellent area is preferably provided at an area of a plate precursor which does not contact a dampening water supply roller of a printing press. It may also be provided in the region from an area of a plate precursor which does not contact a dampening water supply roller of a printing press to an area of a plate precursor which contacts a dampening water supply roller of a printing press. The term "water" herein referred to implies a dampening water for printing or an aqueous solution containing not less than 80% by weight of water. The term "a water repellent area" herein referred to is an area in which a contact angle of the area to water is not less than 20°, preferably not less than 40°, and more preferably not less than 60°.

A plate precursor mounted on the plate cylinder of a printing press, in which the water repellent area is provided continuously over the transverse direction (direction parallel to the cylindrical axis) of the plate precursor, can prevent water from penetrating to an area at which the plate precursor is fixed on the plate cylinder or to the plate precursor surface on the supply spool side. The length of this water repellent area in the longitudinal direction (direction perpendicular to the cylindrical axis) of the plate precursor is preferably not less than 5 $\mu$m, more preferably not less than 0.1 mm, and most preferably from 1 mm to 20 mm. Further, such a water repellent area need to be continuously provided, and may be provided discontinuously, as for example, in a dotted form.

The printing plate precursor used in the invention comprises a hydrophilic support, and a layer A capable of being removed by water or both water and ink.

Hydrophilic Support

The hydrophilic support for the printing plate precursor in the invention is obtained by surface treating the surface of a substrate to provide hydrophilicity or by coating a hydrophilic layer on a substrate. Examples of the substrate include a metal plate, a plastic film, paper treated with a polyolefin and a combination thereof. The thickness of the substrate is not specifically limited as long as the substrate can be attached on a printing press, but is preferably from 50 to 500 $\mu$m for easy handling.

As the metal plate, iron, stainless steel and aluminum are usable, and aluminum is preferred from the viewpoint of the specific gravity and the stiffness thereof. One embodiment of the hydrophilic support used in the invention is an aluminum plate which has been electrolytically and/or mechanically grained, and then anodized. The typical example is an aluminum plate which has been grained, anodized and subjected to sealing treatment. The thickness of the hydrophilic support is preferably 10 to 500 $\mu$m, more preferably 100 to 500 $\mu$m, and most preferably 200 to 300 $\mu$m.

The graining methods of an aluminum plate include a mechanically graining method and an electrolytically etching method. The mechanically graining methods include a ball graining method, a brush graining method, a liquid horning graining method and a buff graining method. The above methods can be used singly or in combination according to an aluminum material composition. The electrolytically etching is a preferable graining method.

The electrolytically etching is carried out in a bath containing one or more of phosphoric acid, sulfuric acid, hydrochloric acid and nitric acid. After graining, the surface of the aluminum plate is optionally subjected to desmut treatment using an alkaline or acid solution to neutralize and washed with water.

The anodization is carried out by electrolyzing the surface of an aluminum plate in a solution containing one or more of sulfuric acid, chromic acid, oxalic acid, phosphoric acid and malonic acid, using the aluminum plate as an anode. The thickness of the anodization film formed is suitably 1 to 50 mg/dm$^2$, and preferably 10 to 40 mg/dm$^2$.

The sealing treatment is carried out by surface-treating the aluminum plate with a boiling water, steam, a sodium silicate solution or a dichromic acid solution. The aluminum plate can be coated with a water-soluble polymer solution or a zirconium fluoride solution to provide a subbing layer on the plate.

Another embodiment of the hydrophilic support comprises a flexible substrate and provided thereon, a hydrophilic layer containing a hydrophilic binder and/or hydrophilic particles such as film-forming colloidal silica particles, the layer being optionally cross-linked. Examples of the flexible substrate used in the hydrophilic support include a plastic film such as a polyethylene terephthalate film, a polyethylene naphthalate film, a cellulose acetate film, a polystyrene film or a polycarbonate film, and paper. A subbing layer may be provided on the flexible substrate in order to increase adhesion between the substrate and the hydrophilic layer. The hydrophilic layer herein referred to may be a layer having a certain thickness, or may be a layer consisting of hydrophilic particles which are adhered onto the surface of the substrate. One or more intermediate layers may be provided between the hydrophilic layer and the flexible substrate. The thickness of the hydrophilic layer is preferably 1.0 to 10 $\mu$m, and more preferably 1.5 to 6.0 $\mu$m.

Examples of the hydrophilic binder include a homopolymer of vinyl alcohol, acrylamide, methylolacrylamide, methylolmethacrylamide, acrylic acid, methacrylic acid, hydroxyethyl acrylate or hydroxyethyl methacrylate; a copolymer comprising one or more of the above-described monomers; maleic acid-vinylmethyl ether copolymer; and saccharides or their derivatives. Examples of the film-forming hydrophilic particles include rosary-shaped or necklace-shaped colloidal silica particles, alumina particles, titanium oxide particles, and other metal oxide particles.

Examples of the cross-linking agent for cross-linking a hydrophilic binder include formaldehyde, glyoxal, polyisocyanate, and hydrolyzed tetraalkylorthosilicate.

The layer A, which is capable of being removed by water or both water and ink, preferably contains at least one of heat fusible particles and thermoplastic particles and at least one of water soluble materials and water swellable materials.

The heat fusible particles or thermoplastic particles are preferably particles of waxes, acryl resins, or synthetic rubbers each having a melting point of 70 to 180° C. As the waxes, natural waxes such as carnauba wax, bees wax, spermaceti wax, Japan wax, jojoba oil, lanolin, ozocerite, paraffin wax, montan wax, candelilla wax, ceresine wax, microcrystalline wax and rice wax, polyethylene wax, FT wax, montan wax derivatives, paraffin wax derivatives, microcrystalline wax derivatives, or higher fatty acids are preferable. Examples of the acryl resins include polymers or copolymers obtained by polymerizing one or more of methyl methacrylate, butyl acrylate, octyl acrylate, 2-ethylhexyl acrylate and styrene. Examples of the synthetic rubbers include polybutadiene, polyisoprene, polychloroprene, styrene-butadiene copolymer, an acrylate-butadiene copolymer, a methacrylate-butadiene copolymer, isobutylene-isoprene copolymer, acrylonitrile-butadiene copolymer and acrylonitrile-isoprene copolymer. Besides the above, examples of the heat fusible particles or thermoplastic particles include particles of ionomer resins, vinyl acetate resins, vinyl chloride resins, urethane resins, polyesters, fluorinated resins, and silicone resins.

The preferred heat fusible particles or thermoplastic particles are particles of carnauba wax, candelilla wax, or FT wax.

The heat fusible particles or thermoplastic particles can be prepared according to conventional preparation methods, for example, a method disclosed in "Bunsangijutsu Sogoshiryoshu" published by Keiei Kaihatsu Center Shuppanbu. As another preparation method, the heat fusible particles or thermoplastic particles are prepared in the form of an aqueous dispersion in which a heat fusible resin is dispersed by fusibly mixing a heat fusible substance with hydrophilic substances such as a hydrophilic binder or colloidal silica particles, pouring the resulting mixture into warm water, and then vigorously stirring the mixture in a stirrer or a homogenizer, or by jetting the mixture through small holes into water.

Examples of the water soluble materials or water swellable materials include conventional water soluble polymers, for example, a synthetic homopolymer or copolymer such as polyvinyl alcohol, poly(meth)acrylic acid, poly (meth)acrylamide, polyhydroxyethyl(meth)acrylate or polyvinyl methyl ether; and a natural binder such as gelatin; polysaccharides or oligosaccarides, for example, dextrane, pullulan, cellulose, trehalose, maltose, lactose or sucrose; gum arabic; alginic acid; polyethylene glycol; or polyethylene oxide. The content of the water soluble materials or water swellable materials in the layer A in the invention is preferably 5 to 70 weight %, and more preferably 10 to 60 weight %.

The layer A or a layer adjoining the layer A may contain a light-heat conversion material, which is capable of generating heat on absorption of laser rays.

The light-heat conversion material is preferably a compound which absorbs light and efficiently converts to heat, although different due to a light source used. For example, when a semi-conductor laser emitting near-infrared light is used as a light source, a near-infrared absorbent having absorption in the near-infrared light region is preferably used. Examples of the near-infrared absorbent include an inorganic compound such as carbon black, an organic compound such as a cyanine dye, a polymethine dye, an azulenium dye, a squalenium dye, a thiopyrylium dye, a naphthoquinone dye or an anthraquinone dye, and an organic metal complex of phthalocyanine, azo or thioamide type.

When an image is formed according to a heat-fusion method employing a printing plate precursor comprising a layer A capable of being removed by water or both water and ink on a printing press, the method as described in item 3 or 4 is effectively employed. For example, when a plate precursor comprising a layer, which is capable of being removed by water or both water and ink, and contains at least one of heat fusible particles and thermoplastic particles and at least one of water soluble materials and water swellable materials, is irradiated with infrared laser, the layer or a heat generation layer adjoining the layer (the heat generation layer contains a light-heat conversion material) generates heat, whereby the heat fusible particles and/or thermoplastic particles are heat-fused to provide a water repellent area on the plate precursor. Provision of the water repellent area on the plate precursor can be carried out employing exposure by an infrared laser installed in a printing press as an image forming system. Provision of the water repellent area by an infrared laser can be carried out at the same time as imagewise exposure, in a system in which image information data necessary to print and data pre-designating a water repellent area are inputted. Exposure for providing a water repellent area can also be carried out, after imagewise exposure is carried out according to the image information data necessary to print. A water repellent area of a plate precursor mounted on a plate cylinder may be provided at an area (a portion to be unused for printing) closer to the rotational axis than an area for printing, the plate precursor surface to be printed. In such a case, infrared laser may be focused on that area during the water repellent area formation due to infrared laser exposure. Alternatively, infrared laser exposure for providing such a water repellent area may be conducted out of focus, since the exposure does not require a high dissolving power in that area.

The water soluble materials herein referred to means materials having a solubility in 100 g of 25° C. water of not less than 0.1 g, and the water swellable materials herein referred to means materials in which the weight after they are immersed in 25° C. water is not less than 1.7 times that before the immersion.

The layer A has a thickness of preferably 0.01 to 10 g/m more preferably 0.1 to 3 g/m$^2$, and most preferably 0.3 to 1 g/m$^2$.

Provision of the water repellent area on the plate precursor carried out by contacting the area with a heated member also uses the same mechanism as above. Temperature of the heated member is preferably 60 to 300° C., more preferably 80 to 250° C., and most preferably 100 to 200° C.

In FIG. 2(*a*) is shown one embodiment of constructions capable of providing a water repellent area by contacting a printing plate precursor with a contact member heated. FIG. 2(*a*) is a sectional view of a plate cylinder of a printing press having a plate precursor in the roll form within the plate cylinder. In FIG. 2(*a*), a water repellent area providing device 5, which employs a contact member heated, comprises a contact member 5*c*, a heater 5*b* which can heat the contact member 5*c* to a predetermined temperature, and a rotational axis 5*a*, the contact member 5*c* rotating in the direction 5*d* (shown by an arrow) around the rotational axis 5*a* as a rotation center to contact the plate precursor.

The contact member 5*c* has a width (a width in the same direction as a rotational axis of the plate cylinder) equal to or greater than that of the printing plate precursor 2, or has a width smaller than that of the printing plate precursor 2 and has a scanning contact function capable of contacting the entire width of the plate precursor.

FIG. 2(*b*) shows a state in which the contact member 5*c* contacts the printing plate precursor 2. As is shown in FIG. 2(*b*), the contact member 5*c* contacts an area of the plate precursor 2 other than an area for printing (that is, an area in which the plate precursor does not directly contact printing ink or a dampening water) and provides a water repellent area in that area.

The method of item 6 is effectively applied to any type printing plate precursor having a layer A capable of being removed by a dampening water or both ink and a dampening water. In the method of item 5, the water repellent area can be also formed by an extremely easy method of drawing a line with an oily ink of a felt-tip pen.

Exposure applied in the invention is preferably scanning exposure, which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate precursor according to image signals from a computer employing a semi-conductor laser.

Generally, the scanning exposures include the following processes.

(1) a process in which a plate precursor provided on a fixed horizontal plate is scanning exposed in two dimensions, employing one or several laser beams.

(2) a process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) a process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate precursor mounted on a plate cylinder of a printing press is scanning exposed.

As the process (3), a process as disclosed in, for example, Japanese Patent O.P.I. Publication No. 5-131676, can be used. Plural semi-conductor lasers are arranged in one line in the sub-scanning direction at a certain beam pitch, or plural semi-conductor lasers are arranged at a certain beam pitch in the sub-scanning direction and at certain intervals in the main scanning direction, that is, in two dimensions. The spot size of plural laser beams emitted from these semi-conductor lasers are reduced through an optical system comprising an optical fiber, a lens or a mirror so that the laser beams are focused on the plate precursor surface, and accordingly, the surface of the plate precursor is exposed with the reduced beam spots so as to give a predetermined exposure dissolving power. When the semi-conductor lasers are arranged in two dimensions, exposure of the plate precursor surface to the reduced beam spots is also carried out in two dimensions, and therefore, emission of each laser located in the main scanning direction is required to be delayed according to a generated image signal.

The sub-scanning of the laser light is generally carried out by moving an exposure head in the direction parallel to the rotational drum axis by a distance equal to a laser spot size multiplied by the laser beam number per one rotation of the drum. The exposure head may move at a constant speed from the beginning of the exposure till completion thereof, while controlled through a standard signal generated by rotation of the drum, that is, a spiral exposure may be carried out. The exposure head, when passing the part (generally, between the both ends of the plate precursor) on the drum at which the plate precursor is not present, may intermittently move by a predetermined distance. Further, a method as is disclosed in JPA-11-133620 may be used, which comprises a system countering a tendency for the laser beam to incline in the sub-scanning direction, while conducting spiral exposure.

Figure 3:
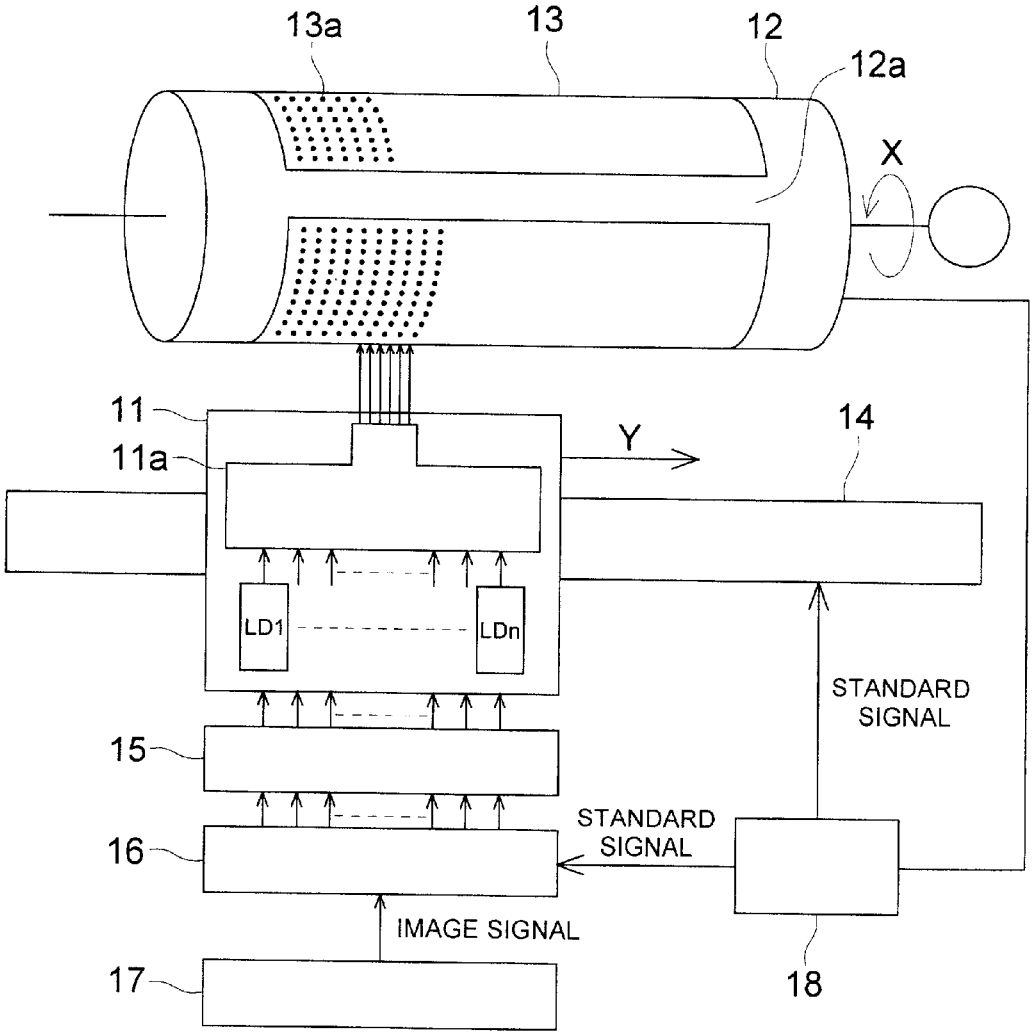
FIG. 3 shows a schematic view of one embodiment of a scanning exposure system used in the invention.

FIG. 3 shows a schematic view of one embodiment of a scanning exposure device comprising n semi-conductor laser sources. The exposure device comprises a rotational drum 12 and an exposure head 11 connected to a moving member 14 which can move exposure head 11 in the direction parallel to the rotational axis of rotational drum 12, that is, in the sub-scanning direction (shown by an arrow "Y" in FIG. 3). An arrow "X" in FIG. 3 shows the main scanning direction. The exposure head 11 comprises n semi-conductor laser sources LD1 through LDn and an optical system 11*a* which makes it possible to expose the surface of a printing plate precursor 13 to each laser beam of a predetermined beam spot size at a predetermined position relationship. A laser source operation signal generating circuit 16 receives both an image signal from a computer 17 and a standard signal generated by a standard signal generating circuit 18, in response to rotation of the drum, and generates a laser source operation signal. A laser source operation circuit 15 receives the laser source operation signal and operates each of the semi-conductor laser sources LD1 through LDn, separately, whereby the surface of a printing plate precursor 13 is imagewise scanning exposed. Numerical number 13*a* shows portions having been exposed of the printing plate precursor 13. Moving member 14 also receives the standard signal and moves the exposure head in the sub-scanning direction by a given distance (by n dots) per one rotation of the rotational drum 12. As described above, this movement may be carried out at a constant speed from the beginning of the exposure till completion thereof, and the exposure head, when passing the portion 12*a* on the drum at which the plate precursor is not present, may intermittently move by a predetermined distance.

Examples of the printing press used in the invention include one comprising the scanning exposure device described above, one comprising the scanning exposure device described above and the heated member contacting device described above, and one comprising the scanning exposure device described above and the oleophilic material coating device described above.

Figure 4:
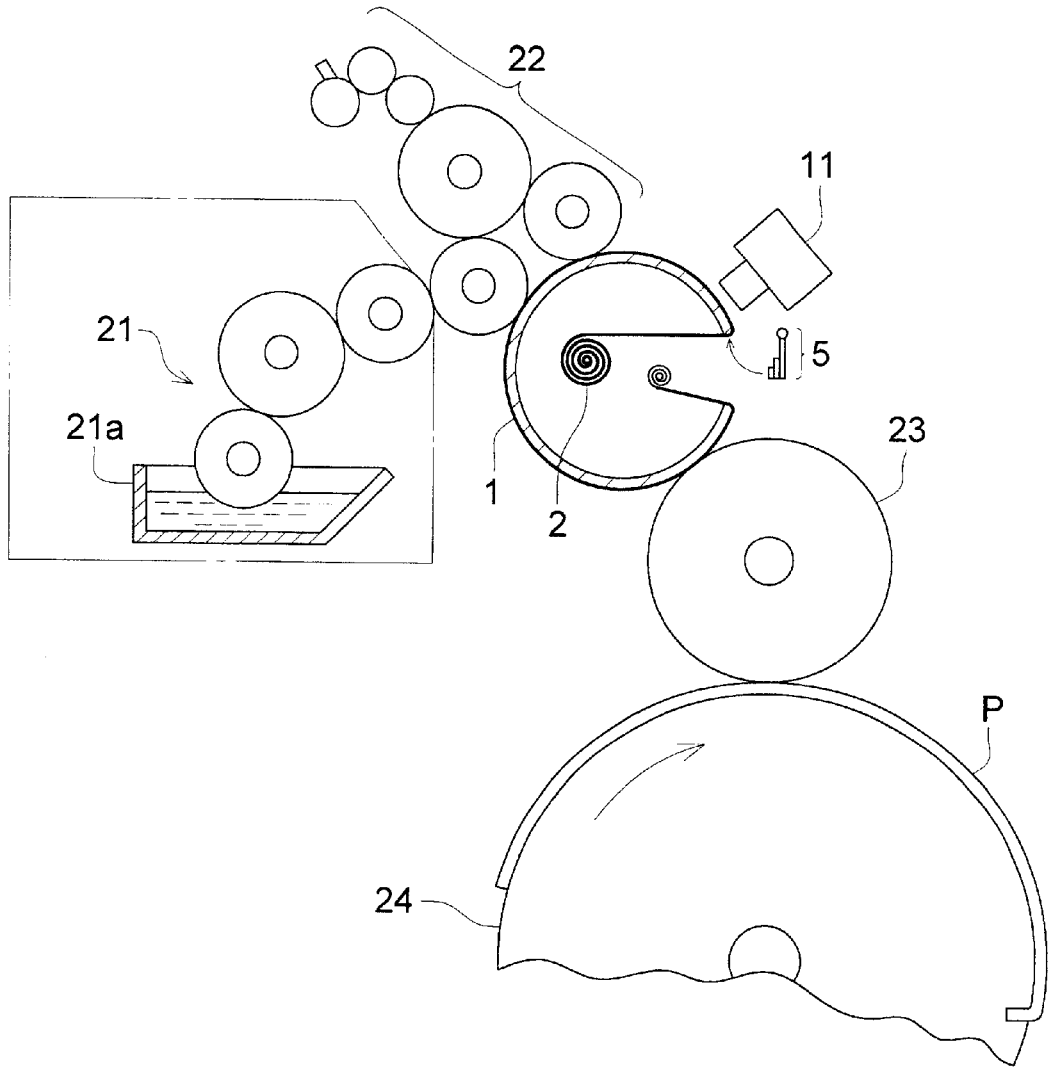
FIG. 4 shows a schematic view of one embodiment of an inventive printing press comprising a scanning exposure system and a heated member contacting system.

FIG. 4 shows a schematic view of one embodiment of a printing press (one unit) comprising a scanning exposure system and a heated member, which is designed so that the heated member contacts an area corresponding to a water repellent area. A dampening water supply device 21 transports a dampening water 21*a* to an ink supply device 22 via a series of drums. Ink is supplied to a printing plate prepared in FIG. 2 or 3 by the ink supply device, transferred from the printing plate to a blanket cylinder 23, and further transferred to a printing paper P on an impression cylinder 24. Thus, printing is carried out to obtain prints.

The printing press of the invention has a construction which is capable of mounting a printing plate precursor comprising a layer A capable of being removed by water or both water and ink on a plate cylinder of the printing press, fixing the printing plate precursor at a fixing section of the plate cylinder, and providing a water repellent area in the layer A so that the water repellent layer is provided between a portion in the layer A for printing and a portion in the layer A at the fixing section before printing is carried out. When a printing plate precursor in roll form is used, the printing press of the invention is preferably a printing press comprising a construction which is capable of storing the printing plate precursor in the roll form on a supply spool which is fixed within the plate cylinder, the printing plate precursor comprising a layer A capable of being removed by water, or both water and ink on the plate cylinder, unrolling and withdrawing the plate precursor around the outer surface of the cylinder, and uptaking the plate precursor on an uptake spool which is fixed within the cylinder, and providing a water repellent area in the layer A so that the water repellent layer is provided between a portion in the layer A for printing and a portion in the layer A at the edge of the printing plate precursor on the supply spool side.

The printing press is more preferably a printing press comprising a construction in which the water repellent area in the layer A is formed by exposing an area corresponding to the water repellent area in the layer A to infrared laser, by contacting an area corresponding to the water repellent area in the layer A with a heated member, or by coating an oleophilic material on an area corresponding to the water repellent area in the layer A.

In a printing press having an infrared laser exposure system, the width over which the infrared laser can carry out scanning exposure is preferably the same as or greater than the width of a printing plate precursor mounted on a plate cylinder of the printing press.

EXAMPLES

Preparation of Printing Plate Precursor (Support)

A subbing layer comprised of two layers was coated on both sides of a 0.04 mm thick PET film according to the following procedures to obtain a support.

1) First Subbing Layer

The surface of the PET film was corona discharged, and the following coating solution was coated onto the discharged surface by a wire bar at 20° C. and 55% RH to obtain a first subbing layer with a dry thickness of 0.4 μm, and dried at 140° C. for 2 minutes.

(Preparation of First Subbing Layer Coating Solution)

| | |
|---|---|
| Acryl latex particles (n-butyl acrylate/t-butyl acrylate/sterene/ hydroxyethyl methacrylate (=28/22/25/25) copolymer) | 36.9 g |
| Surfactant (A) | 0.36 g |
| Hardener (a) | 0.98 g |

Distilled water was added to the above composition to make 1,000 ml to obtain a first subbing layer coating solution.

2) Second Subbing Layer

The surface of the first subbing layer was corona discharged, and the following coating solution was coated onto the discharged surface by an air knife method at 35° C. and 22% RH to obtain a second subbing layer with a dry thickness of 0.1 μm, and dried at 140° C. for 2 minutes.

Thus, a support was obtained.

(Preparation of Second Subbing Layer Coating Solution)

| | |
|---|---|
| Gelatin | 9.6 g |
| Surfactant (A) | 0.4 g |
| Hardener (b) | 0.1 g |

Distilled water was added to the above composition to make 1,000 ml to obtain a second subbing layer coating solution.

Surfactant (A)

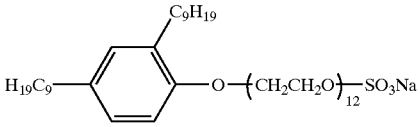

Hardener (a)

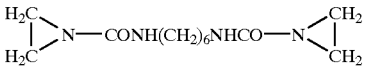

Hardener (b)

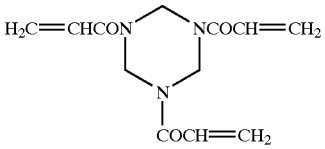

Preparation of Printing Plate Precursor (A)

A hydrophilic layer coating solution having the following composition was filtered, then coated on the subbing layer on one side of the above obtained support by a #10 wire bar, and dried at 80° C. for 5 minutes.

Colloidal silica (alkali type) Snowtex S
(solid 30% by weight, produced by Nissan Kagaku Co., Ltd.) 30.0 parts by weight Necklace shaped colloidal silica (alkali type)
Snowtex PSM (solid 20% by weight, produced by Nissan Kagaku Co., Ltd.) 50.0 parts by weight Matting agent Silton AMT 08 (porous aluminosilicate particles having an average particle size of 0.6 μm, produced by Mizusawa Kagaku Co., Ltd.) 6.0 parts by weight Graphite aqueous dispersion solution, HITASOL GA-66M
(Solid content 10% by weight, produced by Hitachi Funmatsuyakin Co., Ltd.) 14.0 parts by weight Deionized water was added to the above composition to give a solid content of 20% by weight, and sufficiently mixed with stirring.

A layer A coating solution (for a layer A capable of being removed by water or both water and ink on a printing press) having the following composition comprising a water soluble resin and heat fusible fine particles was filtered, then coated on the above obtained hydrophilic layer by a #4 wire bar, and dried at 55° C. for 5 minutes to give a dry thickness of 0.6 g/m$^2$.

Aqueous 6% by weight solution of disaccharide trehalose powder (Trehaose, mp. 97° C., produced by Hayashihara Shoji Co., Ltd.) 55.0 parts by weight Emulsion obtained by diluting, with deionized water, Carnauba wax emulsion A118 (having a solid content of 40% by weight, the wax having
an average particle size of 0.3 μm,
a melting viscosity at 140° C. of 8×10$^{-3}$ P·s,
a softening point of 65° C.,
and a melting point of 80° C., produced by GifuCerac Co., Ltd.) to give a solid content of 6% by weight 45.0 parts by weight The resulting material was aged at 55° C. for 24 hours. Separately, a polyurethane type adhesive layer was coated on the surface of a 0.2 mm thick degreased aluminum (material 1050) substrate to give a layer thickness of 3 g/m$^2$. The resulting aluminum substrate was laminated with the above-obtained material so that the adhesive layer faced the surface of the PET film opposite the layer A. The resulting laminate was aged at 55° C. for 24 hours, and cut into a size of 730 mm×600 mm. Thus, a printing plate precursor (A) was obtained.

Preparation of Printing Plate Precursor (B)

A ablating layer coating solution having the following composition was filtered, then coated on the above obtained support by a #10 wire bar, and dried at 55° C. for 5 minutes.

Colloidal silica (alkali type) Snowtex S
(solid 30% by weight, produced by Nissan Kagaku Co., Ltd.) 30.0 parts by weight Necklace shaped colloidal silica (alkali type)
Snowtex PSM (solid 20% by weight, produced by Nissan Kagaku Co., Ltd.) 30.0 parts by weight Carnauba wax emulsion A118 (having a solid content of 40% by weight, the wax having
an average particle size of 0.3 μm,
a melting viscosity at 140° C. of 8×10$^{-3}$ P·s,
a softening point of 65° C. and
a melting point of 80° C.,
produced by GifuCerac Co., Ltd.) 20.0 parts by weight Carbon black aqueous dispersion SD9020
(Solid content of 30% by weight, produced by Dainippon Ink Co., Ltd.) 20.0 parts by weight Deionized water was added to the above composition to give a solid content of 10% by weight, and sufficiently mixed with stirring.

A hydrophilic layer coating solution having the following composition was filtered, then coated on the above obtained ablating layer by a #4 wire bar, and dried at 55° C. for 5 minutes.

Colloidal silica (alkali type) Snowtex XS
(solid content 20% by weight, produced by Nissan Kagaku Co., Ltd.) 50.0 parts by weight Necklace shaped colloidal silica (alkali type)
Snowtex PSM (solid content 20% by weight, produced by Nissan Kagaku Co., Ltd.) 47.0 parts by weight Matting agent Silton AMT 08
(porous aluminosilicate particleshaving an average particle size of 0.6 μm, produced by Mizusawa Kagaku Co., Ltd.) 2.0 parts by weight Deionized water was added to the above composition to give a solid content of 10% by weight, and sufficiently mixed with stirring.

A layer A coating solution (for a layer A capable of being removed by water or both water and ink on a printing press) comprising carboxymethyl cellulose sodium salt in an amount of 3% by weight as a water soluble resin was filtered, then coated on the above obtained hydrophilic layer by a #6 wire bar, and dried at 55° C. for 5 minutes to give a dry thickness of 0.6 g/m$^2$. Separately, a polyurethane type adhesive layer was coated on the surface of a 0.2 mm thick degreased aluminum (material 1050) substrate to give a layer thickness of 3 g/m$^2$. The resulting aluminum substrate was laminated with the above-obtained material so that the adhesive layer faced the surface of the PET film opposite the layer A. The resulting laminate was aged at 55° C. for 24 hours, and cut into a size of 730 mm×600 mm. Thus, a printing plate precursor (B) was obtained.

The printing plate precursors according to the methods as described below were mounted on a plate cylinder of a printing press, and processed to give a printing plate for printing according to the designation if any. Subsequently, printing was carried out according to the following printing process. After one thousand prints were printed, printing was stopped, and the surface at the vicinity of the plate edges of the printing plate, which was fixed at the plate edges, was observed. The results are shown in Table 1.

Printing Process

As a printing press, DAIYA 1F-1 produced by Mitsubishi Jukogyo Co., Ltd., was employed. Printing was carried out employing a coated paper, a dampening water (H solution SG-51 with a concentration of 1.5%, produced by Tokyo Ink Co., Ltd.), and printing ink (Toyo king Hyecho M Magenta, produced by Toyo Ink Manufacturing Co.).

Comparative Example 1

The printing plate precursor (A) was wound around a drum of a laser exposure device with the layer A capable of being removed on a printing press facing outwardly, and the portions to be printed of the plate precursor were imagewise exposed to infrared laser (having a wavelength of 830 nm) at a resolving degree of 4,000 dpi (the laser light spot diameter was 6 $\mu$m). The exposure amount was 250 mj/cm$^2$ at the surface of the plate precursor. The term, "dpi" shows the number of dots per 2.54 cm. Thus, comparative printing plate 1 was prepared.

Comparative Example 2

The printing plate precursor (B) was wound around a drum of a laser exposure device with the layer A capable of being removed on a printing press facing outwardly, and the portions to be printed of the plate precursor were imagewise exposed to infrared laser (having a wavelength of 830 nm) in a resolving degree of 4,000 dpi (the laser light spot diameter was 6 $\mu$m). The exposure amount was 400 mj/cm$^2$ at the surface of the plate precursor. Thus, comparative printing plate 2 was prepared.

Example 1

The same procedures as comparative example 1 were carried out, except that the printing plate precursor (A) was exposed to form a water repellent area at the same time as the imagewise exposure. Thus, printing plate 1 was prepared.

Uniform exposure was carried out over a first area having a length of 5 mm on the plate between a position 15 mm distant from the leading end and a position 20 mm distant from the leading end where the plate is gripped and fixed on the plate cylinder (a head portion of the plate in the plate cylinder rotational direction) and over a second area having a length of 5 mm on the plate between a position 15 mm distant from the rear end and a position 20 mm distant from the rear end where the plate is also gripped and fixed on the plate cylinder of the plate, whereby two water repellent areas were formed on the plate precursor.

Example 2

A printing plate 2 was prepared in the same manner as in Example 1, except that 50% dot image exposure was carried out instead of the uniform exposure to form a water repellent area. Thus, printing plate 2 was prepared.

Example 3

The printing plate prepared in the same manner as in comparative example 1 was mounted on a plate cylinder of a printing press, and the surface thereof was contacted with metal material heated to 120° C. to form a water repellent area. Thus, printing plate 3 was prepared.

The contact was made over a first area having a length of 3 mm on the plate between a position 15 mm distant from the leading end and a position 18 mm distant from the leading end where the plate is gripped and fixed, and over a second area having a length of 3 mm on the plate between a position 15 mm distant from the rear end and a position 18 mm distant from the rear end where the plate is also gripped and fixed, whereby two water repellent areas were formed on the plate precursor.

Example 4

The printing plate prepared in the same manner as in comparative example 1 was mounted on a plate cylinder of a printing press, and lines were drawn with an oily ink of a felt-tip pen to form a water repellent area. Thus, printing plate 4 was prepared.

Two water repellent areas were formed over a first area having a length of 5 mm on the plate between a position 15 mm distant from the leading end and a position 20 mm distant from the leading end where the plate is gripped and fixed, and over a second area having a length of 5 mm on the plate between a position 15 mm distant from the rear end and a position 20 mm distant from the rear end where the plate is also gripped and fixed.

Example 5

The printing plate prepared in the same manner as in comparative example 2 was mounted on a plate cylinder of a printing press, and water repellent areas were formed in the same manner as in Example 4. Thus, printing plate 5 was prepared.

TABLE 1

| Example/Comparative example | Observation of printing plate surface near the plate edges where the plate were gripped and fixed |
|---|---|
| Comparative example 1 | Dampening water penetrated to the printing plate surface at the plate edges. |
| Comparative example 2 | Dampening water penetrated to the printing plate surface at the plate edges. |
| Example 1 | The water repellent areas prevented dampening water from penetrating to the printing plate surface at the plate edges. |
| Example 2 | The water repellent areas prevented dampening water from penetrating to the printing plate surface at the plate edges. |
| Example 3 | The water repellent areas prevented dampening water from penetrating to the printing plate surface at the plate edges. |
| Example 4 | The water repellent areas prevented dampening water from penetrating to the printing plate surface at the plate edges. |
| Example 5 | The water repellent areas prevented dampening water from penetrating to the printing plate surface at the plate edges. |

As is apparent from Table 1 above, the printing method of the invention prevents a dampening water from penetrating to the surface at the edges of an on-press type printing plate where the plate is gripped and fixed. Further, it is apparent that when an on-press type printing plate precursor is stored in the roll form within the plate cylinder, the printing method of the invention can prevent a dampening water from penetrating to the surface of the plate precursor on the supply spool side, and can minimize deterioration of performance of the plate precursor. It is also apparent that a printing press having a construction capable of realizing the printing method of the invention is effectively used in the invention.

[Effects of the Invention]

The present invention provides a printing method employed an on-press type printing plate precursor and improving a fixing stability and a registering accuracy, and provides a printing method employing an on-press type printing plate precursor in the roll form stored within a plate cylinder of a printing press and minimizing deterioration of printing performance thereof. Further, the present invention provides a printing press capable of realizing the printing method described above.

What is claimed is:

1. A method of printing employing a printing plate prepared from a printing plate precursor comprising a layer A capable of being removed by water or both water and ink on a printing press, the method comprising the steps of:

(a) imagewise exposing the printing plate precursor;

(b) mounting the printing plate precursor on a plate cylinder of the printing press to fix the printing plate precursor at a fixing section on the plate cylinder;

(c) providing a water repellent area in the layer A of the printing plate precursor so that the water repellent area is provided between a portion of the layer A to be used for printing and a portion of the layer A in the fixing section not to be used for printing;

(d) supplying water or both water and ink to the resulting printing plate precursor to obtain a printing plate; and (e) then carrying out printing while supplying water or both water and ink to the resulting printing plate.

2. The method of claim 1, wherein the water repellent area in the layer A is provided continuously in the direction (a transverse direction of the plate precursor) normal to the rotational direction of the plate cylinder.

3. The method of claim 1, wherein the water repellent area in the layer A is formed by exposing to an infrared laser an area corresponding to the water repellent area.

4. The method of claim 1, wherein the water repellent area in the layer A is formed by contacting an area corresponding to the water repellent area with a heated member.

5. The method of claim 1, wherein the water repellent area in the layer A is formed by coating an oleophilic material on an area corresponding to the water repellent area.

6. A method of printing employing a printing plate prepared from a printing plate precursor comprising a layer A capable of being removed by water or both water and ink on a printing press comprising a plate cylinder, and a supply spool for storing and supplying the printing plate precursor in a roll form and an uptake spool for uptaking the plate precursor, which are fixed within the plate cylinder, the printing press being constructed so that the printing plate precursor is withdrawn from the supply spool, brought on an outer surface of the plate cylinder to wind therearound, and uptaken by the uptake spool, the method comprising the steps of:

(a) bringing the printing plate precursor on the outer surface of the plate cylinder to wind therearound;

(b) imagewise exposing the wound printing plate precursor;

(c) providing a water repellent area in the layer A of the plate precursor so that the water repellent layer is provided between a portion of the layer A to be used for printing of the layer A and a portion of the layer A not to be used for printing on the supply spool side;

(d) supplying water or both water and ink to the resulting printing plate precursor to obtain a printing plate; and (e) then carrying out printing while supplying water or both water and ink to the resulting printing plate.

7. The method of claim 6, wherein the water repellent area in the layer A is provided continuously in the direction (a transverse direction of the plate precursor) normal to the rotational direction of the plate cylinder.

8. The method of claim 6, wherein the water repellent area in the layer A is formed by exposing to an infrared laser an area corresponding to the water repellent area.

9. The method of claim 6, wherein the water repellent area in the layer A is formed by contacting an area corresponding to the water repellent area with a heated member.

10. The method of claim 6, wherein the water repellent area in the layer A is formed by coating an oleophilic material on an area corresponding to the water repellent area.

11. A printing press capable of mounting a printing plate precursor comprising a layer A capable of being removed by water or both water and ink on the printing press, the printing press comprising:

(a) a plate cylinder for mounting the printing plate precursor;

(b) a fixing section at which the printing plate precursor is fixed on the plate cylinder;

(c) a water-repellency providing member for providing a water repellent area in the layer A so that the water repellent area is provided between a portion of the layer A to be used for printing and a portion of the layer A in the fixing section not to be used for printing before printing is carried out, wherein the water-repellency providing member is a heated member which is constructed so that the heated member contacts an area corresponding to the water repellent area; and (d) an exposure member for forming an image on said printing plate precursor, said exposure member positioned after the water repellency providing member in a direction of winding the printing plate precursor around the plate cylinder.

12. A printing press comprising:

(a) a plate cylinder;

(b) a supply spool for storing and supplying a printing plate precursor in a roll form, which is fixed within the plate cylinder, the printing plate precursor comprising a layer A capable of being removed by water or both water and ink on the plate cylinder;

(c) a winding member for unrolling and winding the plate precursor around the plate cylinder;

(d) an uptake spool for uptaking the plate precursor, which is fixed within the plate cylinder;

(e) a water-repellency providing member for providing a water repellent area in the layer A so that the water repellent area is provided between a portion of the layer A to be used for printing and a portion of the layer A not to be used for printing on the supply spool side wherein the water-repellency providing member is a heated member which is constructed so that the heated member contacts an area corresponding to the water repellent area; and (f) an exposure member for forming an image on said printing plate precursor, said exposure member positioned after the water repellency providing member in the direction of winding the printing plate precursor around the plate cylinder.

* * * * *